US005301422A

United States Patent [19]

Uzelac

[11] Patent Number: 5,301,422

[45] Date of Patent: Apr. 12, 1994

[54] APPARATUS FOR JOINING TRANSMISSION CABLES

[75] Inventor: Milan Uzelac, Highland, Ind.

[73] Assignee: G & W Electric Company, Blue Island, Ill.

[21] Appl. No.: 847,191

[22] Filed: Mar. 6, 1992

[51] Int. Cl.[5] ..... H01R 43/00; H01R 11/09

[52] U.S. Cl. ..... 29/869; 29/755; 439/796

[58] Field of Search ..... 29/857, 861, 868, 869, 29/755; 439/796, 797, 801, 583, 584, 585; 403/184, 261, 301, 294, 296, 338

[56] References Cited

U.S. PATENT DOCUMENTS

| | | | |
|---|---|---|---|
| 2,931,009 | 3/1960 | Dutton et al. | 403/184 X |
| 3,992,569 | 11/1976 | Hankins et al. | 29/868 X |
| 4,458,976 | 7/1984 | Hudson et al. | 439/797 |
| 4,710,593 | 12/1987 | Hall, Jr. et al. | 29/868 X |

*Primary Examiner*—Mark Rosenbaum
*Assistant Examiner*—K. V. Nguyen
*Attorney, Agent, or Firm*—Laff, Whitesel Conte & Saret

[57] ABSTRACT

A device for joining sections of solid-dielectric underground cable comprises conductor extension pieces or ferrules respectively attached to the center conductors of each of the cable sections, conductor inserts installed in a cavity of each of the ferrules, and a conductor clamp for clamping the ferrules together in a predetermined longitudinal arrangement. The conductor clamp comprises a pair of semi-cylindrical shell pieces which, when assembled together, form a modified cylindrical structure having a central aperture for receiving the ferrules. Each conductor insert includes a disk-shaped flange plate on its outer end. Fasteners are used to compress the shell pieces toward one another into secure engagement with the ferrules, so that the ferrules, and the center conductors to which they are attached, are retained in a desired predetermined mechanical relationship. The flange plates of the conductor inserts are larger than the central aperture of the assembled clamp so that the flange plates are longitudinally constrained by the walls of the cavity. As a result, the assembly can withstand large forces in tension and compression which may be produced due to thermal expansion and contraction of the cable.

13 Claims, 5 Drawing Sheets

APPARATUS FOR JOINING TRANSMISSION CABLES

BACKGROUND OF THE INVENTION

This invention relates to electric power transmission and distribution equipment, and more particularly to devices for joining sections of certain types of electric power transmission cables.

Electric power is often transmitted at voltages exceeding 50 kV in order to reduce power losses caused by the resistance of the conductors. Traditionally, such high-voltage conductors have been suspended high above the ground from towers or other suitable supports in order to isolate them from the ground and from other objects where a high difference of potential would exist between the conductors and the objects. In such applications, the conductors are electrically insulated from the supports by suitable insulator apparatus, and from everything else by the air present in the region around the conductor. As is well known, an electric field surrounds the conductor. Because air has a relatively low dielectric strength, the conductors must be separated from other objects by a relatively large distance to prevent the electric field gradient in the region between the conductor and the object from exceeding dielectric strength of the insulating air.

The above-ground transmission of electric power via suspended conductors may be inappropriate for certain applications. In some cases, the requirement that the conductors be spaced far from other objects is inconsistent with existing or planned land use patterns. In other cases, aesthetic considerations preclude the use of the large towers or other supports required. One possible solution to this problem would be to locate air-insulated conductors underground in suitable vaults, but the need to maintain adequate physical separation between each conductor and other conductors and surrounding objects would require huge vaults and renders this solution economically infeasible.

For these and other reasons, systems have been designed to permit electricity to be transmitted at high voltages through suitable cables having configurations which do not require large physical spacing between the conductor and other objects. In one such cable configuration, a center conductor is surrounded by a layer of an appropriate solid dielectric material, such as polyethylene. The solid dielectric layer is, in turn, surrounded by a conductive shield. The center conductor, the solid dielectric, and the conductive shield are concentrically disposed. The center conductor has a substantially circular cross section. In order to avoid skin effect, the center conductor may comprise several groups of smaller conductor strands. Such groups are arranged as sectors of the circular center conductor cross section. The conductive shield may be formed as a tubular layer of partially conductive material having one or more drain conductors running along the outside surface of the layer. A corrugated metal tube or other suitable armor may be provided around the conductive shield to provide physical protection against damage to the cable.

The solid dielectric layer is formed from a suitable material having a high dielectric strength to minimize the distance required between the center conductor and the shield for a given operating voltage. This reduces the amount of material required to construct the dielectric layer and all other layers disposed radially outward from the dielectric layer. Accordingly, the weight, cost, and overall diameter of the cable is minimized.

The electrical stress in the region surrounding the center conductor of such cables is high. Special precautions are necessary to avoid electrical breakdown at any place where either the center conductor or the shield conductor are terminated or deformed, because any variation in the geometry of the conductors will cause the stress distribution in the region to change. If the mechanical configuration of the conductors is such that the electrical stress is concentrated, the stress may exceed that which the dielectric medium between the conductors can withstand. In particular, when a section of a cable is joined to another section, the center and shield conductors are necessarily physically discontinuous. Although it is theoretically possible to attach the respective conductors of the two cable sections to produce a configuration within the joint region which is mechanically and electrically identical to that of the cable, it is nearly impossible to achieve this in practice.

Accordingly, when sections of solid-dielectric cable are joined, the joint is typically constructed in a structure designed to reduce the electrical stress in the region of the joint so that the mechanical elements required to create the joint do not produce excessive electrical stress concentrations. Such joints are typically immersed in a suitable container of insulating fluid (e.g. oil), having a high dielectric strength in order to reduce the separation required to avoid breakdown. In addition, conductor arrangements are chosen carefully to avoid sharp edges and other configurations which produce large concentrations of electrical stress and thereby promote breakdown.

It is highly desirable to minimize the number of joints between sections of underground cables. Electrical losses may occur at the joints. In addition, a significant amount of skilled labor is required to build and install the joints, and the material cost of each joint is relatively high. Although cable manufacturers attempt to produce sections of cable which are as long as possible, production processes and other constraints limit the length of a section of cable which can practically and economically be manufactured. In addition, cables used in power transmission applications are relatively heavy, and this weight along with the need to transport the cable from the manufacturer's plant to the place of installation, impose a further limit on the maximum length of a cable section.

A significant problem in the design and construction of underground electric transmission facilities is to join sections of underground cable in a way that provides excellent electrical conductivity and high mechanical strength. Excellent electrical conductivity is important because resistance in the joint causes a portion of the electrical energy flowing through the joint to be converted to waste heat. High mechanical strength is importance because the cable sections may be subject to substantial amounts of mechanical stress. In particular, the cable sections are subject to expansion and contraction as the temperature of the cable and surrounding environment varies. Variations in the cable temperature may occur in part as a result of changes in the amount of current being carried through the cable. These mechanical loads may be sufficient to separate the cables at the joint or otherwise disrupt the joint unless suitable provisions are made to constrain them. In particular, when both cable sections contract, very large tensile loads may be placed on the joint.

Existing joint structures have a variety of disadvantages in underground solid-dielectric cable applications. Several existing techniques are known for joining the center conductors of the two cable sections, including crimping and welding. A problem with both of these techniques is that they produce waste products such as conductive particles and contaminants. As previously mentioned, the joint between cable sections is typically formed within a suitable enclosure which contains an appropriate dielectric fluid such as an insulating oil or a gas such as sulfur hexafluoride (SF6). Any conductive particles or contaminants which may remain after the joint has been constructed may be attracted to regions of high electrical stress and the adjacent conductors.

When such a particle comes into contact with a conductor, it forms a sharp protrusion into the fluid. Such sharp protrusions cause concentrations of electrical stress which may exceed the dielectric strength of the fluid. In addition, such concentrations tend to attract other particles, resulting in progressively longer, breakdown-promoting conductive chains. Also, the by-products of the welding and crimping processes tend to contaminate the environment in which the process is performed. As a result, these processes are not suitable for constructing a joint in high cleanliness environments, such as "clean rooms."

Because the welding or crimping process must be performed as one of the first steps in joint construction, it is difficult or impossible to use certain types of prefabricated joint components in welded or crimped joints. Stress control cones, corona shields, and certain support insulators are preferably constructed as monolithic structures without seams or other structural discontinuities. These components must surround the center conductor, and therefore, if they are monolithically constructed, they must be installed before the welding or crimping step is performed. However, once the components have been installed on the cable, they physically interfere with access required to perform the actual welding or crimping. These components also interfere with installation of the tape layers normally required in welded or crimped joints. Thus, many preferred joint components cannot be used with conventional welded or crimped joints.

Another problem with welded and crimped joints is that the connection cannot be conveniently disconnected as required for maintenance or reconstruction. An additional problem with welded joints is that although welding the conductors provides a good electrical and mechanical connection, it requires precise longitudinal and axial alignment of the conductors, and this alignment is difficult to achieve in field installations.

OBJECTS AND SUMMARY OF THE INVENTION

It is therefore an object of the present invention to provide a device for joining sections of solid-dielectric cable which provides high electrical conductivity and high mechanical strength.

It is another object of the present invention to provide a device for joining sections of solid-dielectric cable which is tolerant of axial misalignment of the center conductors of the cables.

It is a further object of the invention to provide a device for joining sections of solid-dielectric cable which is tolerant of longitudinal misalignment of the center conductors of the cables.

It is another object of the invention to provide apparatus and methods for constructing joints for solid-dielectric cables which allow convenient disconnection and reconnection of the cables.

It is another object of the invention to provide apparatus and methods for constructing joints for solid-dielectric cables which avoid the production of conductive particles which tend to contaminate the dielectric materials within the joint.

It is another object of the invention to provide apparatus and methods for constructing joints for solid-dielectric cables which avoids the production of by-products which tend to contaminate a clean environment.

A device for joining sections of solid-dielectric underground cable constructed according to the present invention comprises conductor extension pieces or ferrules respectively attached to the center conductors of each of the cable sections, conductor inserts installed in a cavity of each of the ferrules, and a conductor clamp for clamping the ferrules together in a predetermined longitudinal arrangement. The conductor clamp comprises a pair of semi-cylindrical shell pieces which, when assembled together, form a modified cylindrical structure having a central aperture for receiving the ferrules. Each conductor insert includes a disk-shaped flange plate on its outer end. The central aperture of the clamp includes a cavity having an enlarged inner diameter for receiving and constraining the disk-shaped flange plates of the conductor inserts. The shell pieces of the clamp are assembled in an opposed relationship to form a modified cylinder surrounding the ferrules and the conductor inserts. Fasteners are used to compress the shell pieces toward one another into secure engagement with the ferrules. The fasteners are removable, thereby allowing the clamp to be disassembled so that the joint may be easily disconnected when required. Four contact surface ridges are provided in the central aperture (two from each of the shell pieces which form the sides of the aperture). The contact ridges rest on the surface of the ferrules when the clamp is assembled. The contact ridges decrease the contact surface area, and therefore increase the contact pressure. The size of the ridges is selected to provide the desired current density.

Since the shell pieces are tightly compressed against the ferrules, the ferrules and the center conductors to which they are attached are retained in a desired predetermined mechanical relationship. In particular, because the flange plates of the conductor inserts are larger than the central aperture of the assembled clamp, the flange plates are longitudinally constrained by the walls of the cavity.

In addition, the compression of the shell piece contact ridges against the ferrules causes the interior walls of the central aperture to bear tightly against the ferrules along a controlled area, thereby producing an electrical connection capable of carrying high currents between these parts. Accordingly, an electrically conductive path is formed from the first cable center conductor through the first ferrule, the conductor clamp, and the second ferrule, to the second cable center conductor. Thus, the inventive clamp both mechanically and electrically joins the center conductors of the cable sections.

BRIEF DESCRIPTION OF THE DRAWINGS

These and other features of this invention will be best understood by reference to the following detailed description of a preferred embodiment of the invention, taken in conjunction with the accompanying drawings, in which.

DETAILED DESCRIPTION OF THE PREFERRED EMBODIMENT

Figure 1:
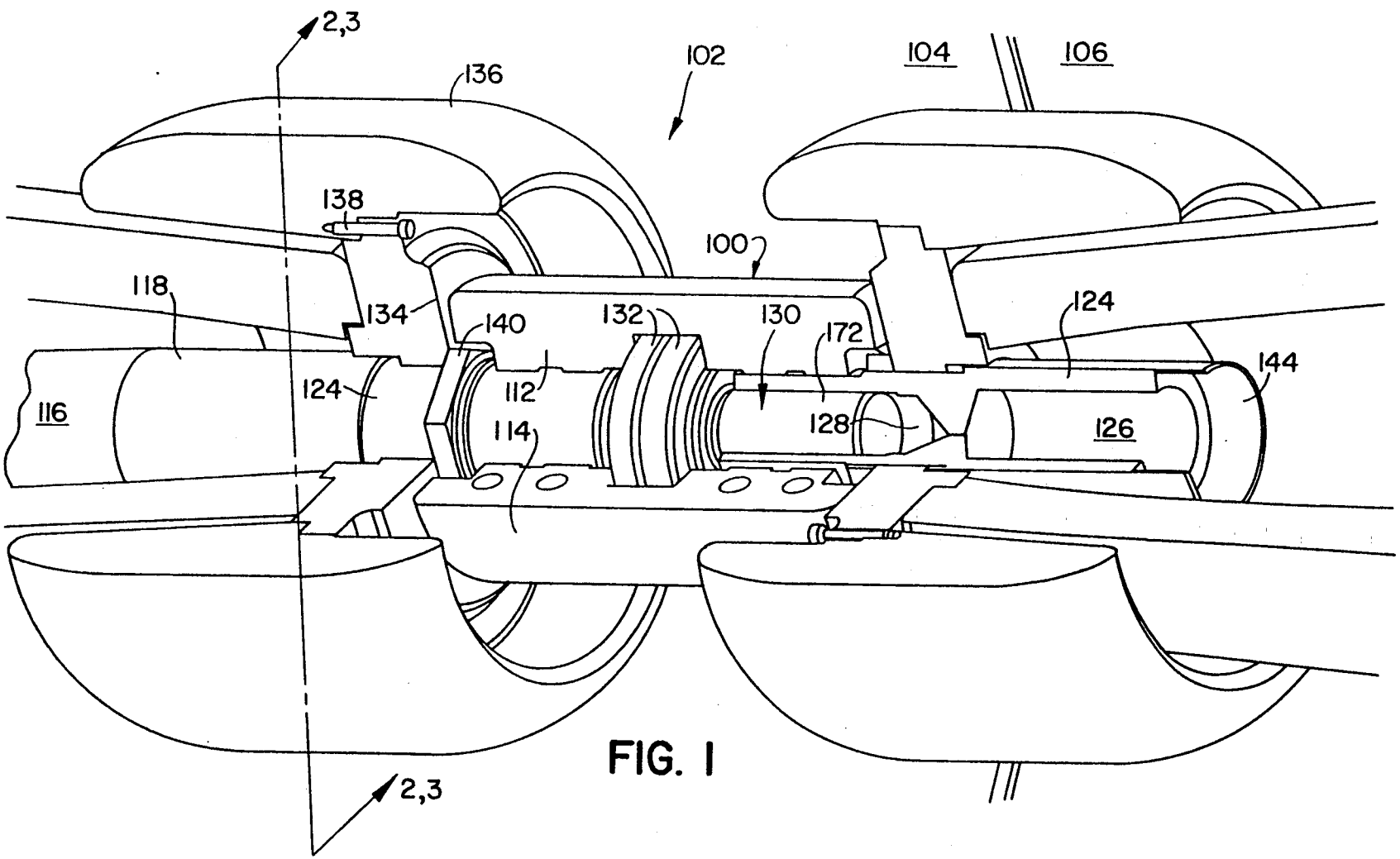
FIG. 1 is a partial side perspective view of a high-voltage cable joint having a conductor clamp constructed according to the present invention, with the right-hand-side cable and a portion of the joint removed to reveal a three-quarter cross section.

A preferred embodiment of a conductor clamp 100 for use in forming connection joints between sections of electric power transmission cables is shown generally in FIGS. 1-6. Although the conductor clamp 100 is described herein for use in a particular environment, this environment is merely one example of an application for which the inventive clamp may be advantageously used.

In an exemplary application, the conductor clamp 100 electrically and mechanically joins the conductor portions 108, 110 (FIGS. 2-3) of first and second sections 148, 158 of an electric power transmission cable adapted for underground burial. Because the cable sections may be subjected to large longitudinal forces, the clamp 100 mechanically secures the sections together in addition to providing a high-current electrical path from one section to another.

In overview, a joint 102 between cable sections 148, 158 is formed by respectively securing a conductor extension piece or ferrule 124 to each of the conductor portions 108, 110. Each of the ferrules 124 has a threaded cavity 128 for receiving a mating threaded conductor insert 130. Each conductor insert 130 includes a disk-shaped flange plate 132 on its outer end. The ends of the cable sections 148, 158 are positioned to oppose one another. The conductor inserts 130 are installed into the threaded cavities 128 of the ferrules 124 and the positions of the inserts are adjusted so that they approximately abut one another.

The conductor clamp 100 comprises first and second clamping elements 112, 114, which may be constructed as semi-cylindrical shell pieces, and which, when assembled together, form a modified cylindrical structure having a central aperture 200 for receiving the ferrules 124. The central aperture 200 includes a cavity 216 having an enlarged inner diameter for receiving and constraining the disk-shaped flange plates 132 of the conductor inserts 130. The shell pieces 112, 114 of clamp 100 are assembled in an opposed relationship to form a modified cylinder surrounding ferrules 124 and conductor inserts 130. As explained in detail below, fasteners 244 are used to compress the shell pieces 112, 114 toward one another into secure engagement with the ferrules 124.

Since the shell pieces 112, 114 are tightly compressed against the ferrules 124, the ferrules and the center conductors 108, 110 to Which they are attached are retained in a desired predetermined mechanical relationship. In particular, because the flange plates 132 of the conductor inserts 130 are larger than the central aperture 200 of the assembled clamp 100, the flange plates 132 are longitudinally constrained by the walls 242 of cavity 216.

In addition, the compression of the shell pieces 112, 114 against ferrules 124 causes the interior walls 220 of the central aperture 200 to bear tightly against the ferrules 124 along a controlled area, thereby producing an electrical connection capable of carrying high currents between these parts. Accordingly, an electrically conductive path is formed from the first cable center conductor 108 through first ferrule 124, clamp 100, and second ferrule 124, to the second cable center conductor 110. Thus, the inventive clamp 100 both mechanically and electrically joins the center conductors 108, 110 of cable sections 148, 158.

Figure 2:
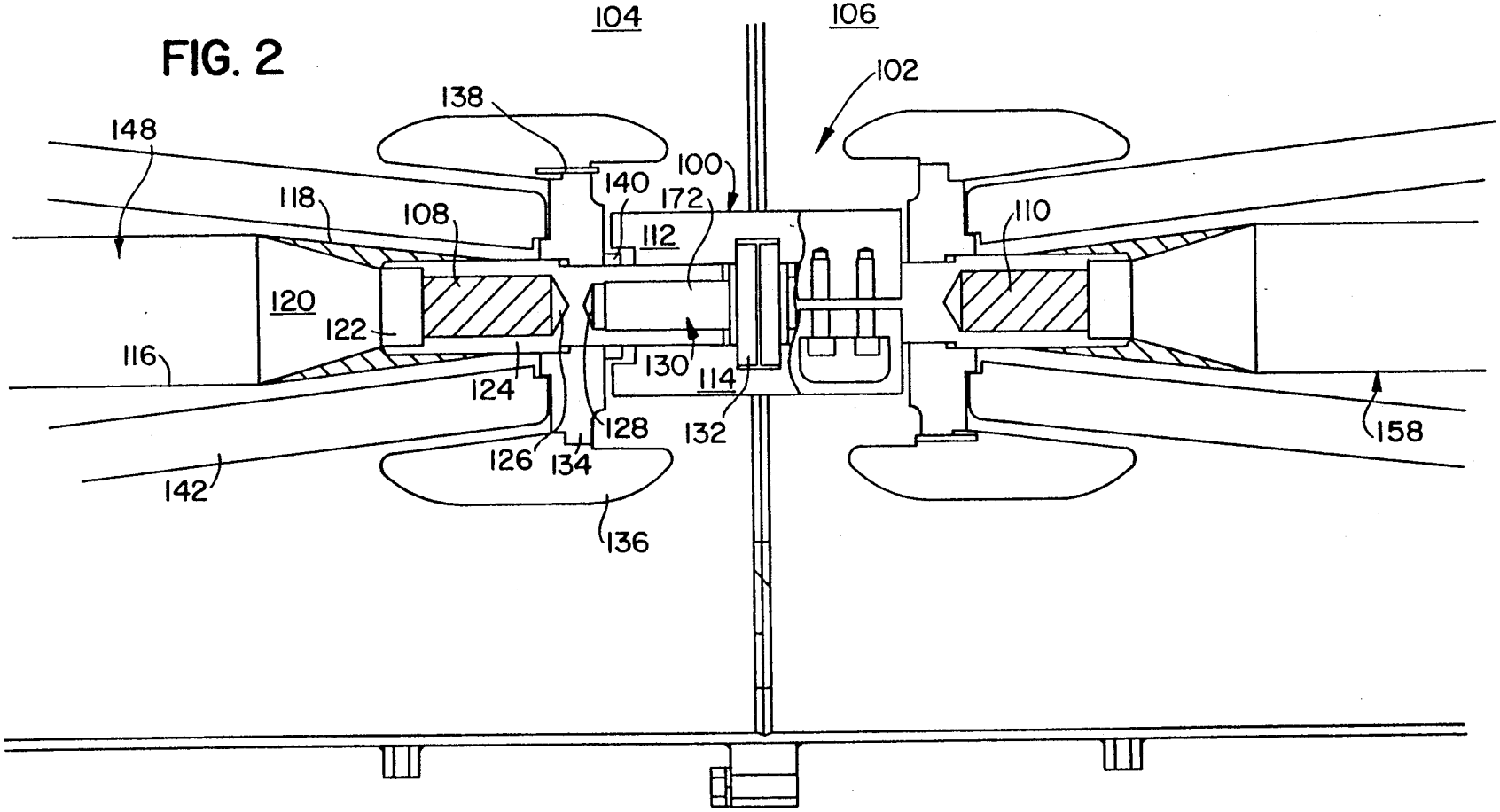
FIG. 2 is a partial cutaway, partial cross-section view of the joint taken along the view lines 2—2 of FIG. 1.
Figure 3:
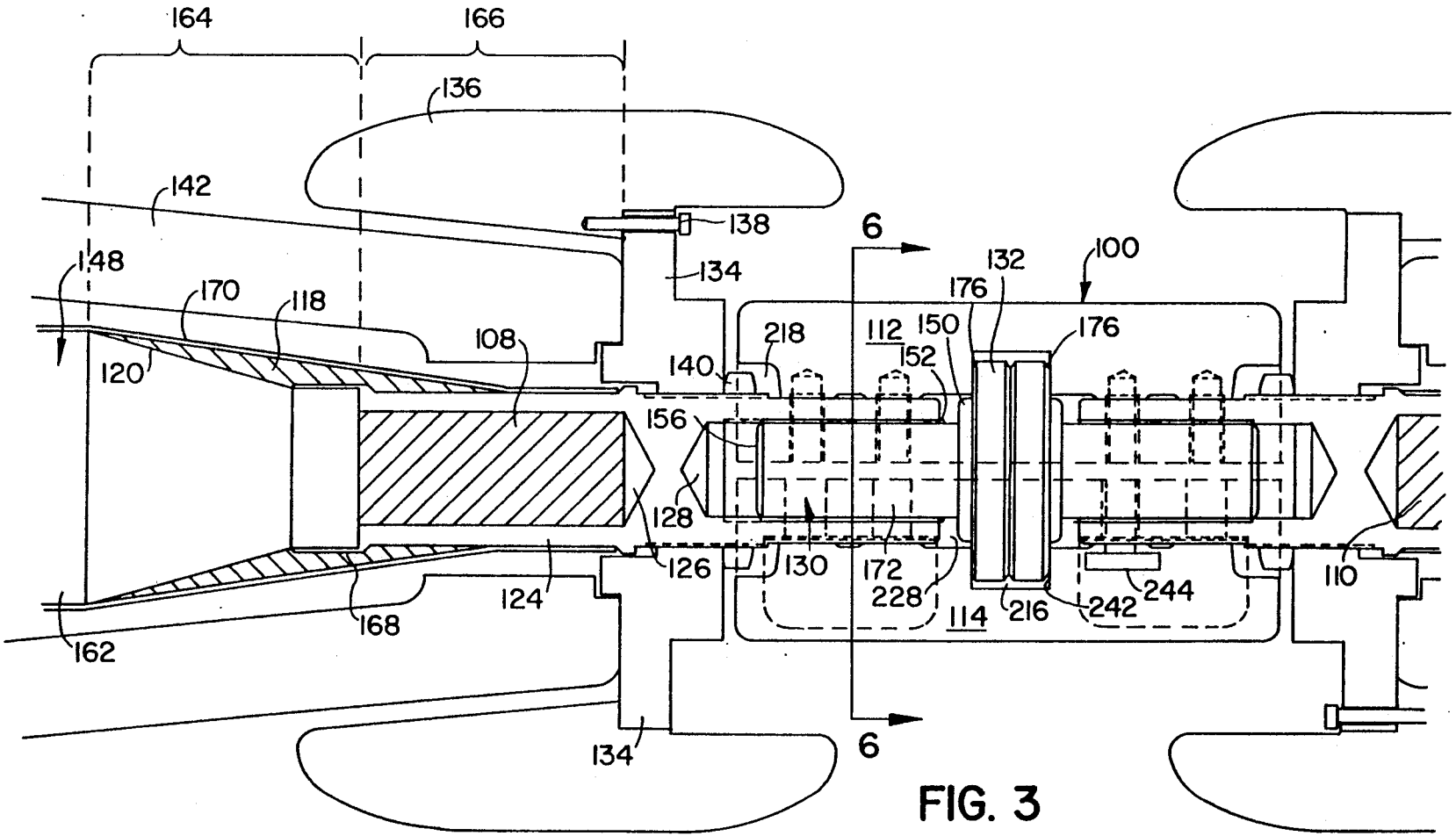
FIG. 3 is an enlarged cross-section view of the conductor clamp taken along the view lines 3—3 of of FIGS. 1-2.

Considered in greater detail, an interior view of an assembly 102 for joining first and second sections 148, 158 of high-voltage electric power distribution cables is shown in FIGS. 1-3. An exemplary type of electric power transmission cable designed for underground installation in high voltage (i.e. over 50 kV) applications is constructed having a center conductor 108, 110, a layer 162 of solid dielectric material surrounding the center conductor, and a conductive shield layer (not shown) surrounding the dielectric layer. An insulating sheath (not shown) may surround the shield. In high-voltage applications involving solid-dielectric cables or other cables permitting a small center-conductor-to-shield spacing, special precautions against electrical breakdown must be taken whenever the shield or center conductor are interrupted or their shape is deformed. Accordingly, the joint 102 between cable sections is preferably formed within a suitable enclosure which preferably contains an appropriate dielectric fluid such as an insulating oil or a gas such as sulfur hexafluoride ($SF_6$). A portion of the enclosure, comprising wall sections 104 and 106, is shown in FIG. 2.

Each end of the cable sections 148, 158 must be suitably prepared for installation in the joint 102. Although this preparation is shown in detail only for cable section 148, cable section 158 is prepared in an equivalent manner. The shield conductor (not shown) is removed from the cable section at a substantial distance from the end of the cable, and known techniques are preferably applied near the end of the shield to reduce electrical stress in the surrounding region. The solid-dielectric layer 162 is removed along a distance 166 from the end of the cable to expose the center conductor 108, 110. The diameter of the solid-dielectric layer 162 is gradually reduced along a distance 164 to form a tapered section 120.

A conductor extension piece or ferrule 124 is installed on the exposed center conductor 108 of the cable section 148. The center conductor 108 is typically formed of a relatively flexible metal, such as copper. The ferrule provides a stable mechanical and electrical interface to the center conductor 108 upon which the conductor clamp 100 may act to securely mechanically and electrically attach the center conductors 108, 110 together.

The ferrule 124 is a generally cylindrical structure having an outside diameter somewhat larger than that of the center conductor 108. The ferrule 124 is preferably constructed of a material having high electrical conductivity and mechanical strength. The ferrule 124 has a first cavity 126 extending longitudinally inward from an end of the ferrule for receiving the exposed portion of the center conductor 108. The ferrule 124 has a second cavity 128 extending longitudinally inward from the opposite end of the ferrule.

The ferrule 124 is installed on the center conductor 108 and is secured thereto to provide a mechanical connection of high strength and an electrical connection of low resistance. The ferrule 124 may be secured to the center conductor 108 using any appropriate method which prevents longitudinal movement of the center conductor 108 with respect to the ferrule 124. The ferrule 124 extends a short distance over the tapered end of the solid-dielectric layer 162.

Preferably, an appropriate insulating material is applied in a tapered layer 118 to the exterior of the solid-dielectric layer 162 and the ferrule 124 in the region surrounding the interface between these components. In addition to providing electrical insulation, the insulating layer 118 seals the interface between the ferrule 124 and the solid-dielectric layer 162 to prevent dielectric fluid contained in the joint enclosure from leaking into the cable center conductor strands. A lip section 168 having an enlarged diameter is provided on the cable end of the ferrule. The lip section 168 interferes with the insulating layer to prevent longitudinal displacement of the ferrule 124 with respect to the solid-dielectric layer 162. A thin additional layer 170, which may be constructed of a suitable insulating tape, is preferably applied to cover those portions of the ferrule 124, tapered layer 118, and solid-dielectric layer 162 which would be otherwise exposed.

In a typical application, several additional components may be provided for electrical stress control within the joint housing. Substantially conical insulators 142 (FIGS. 1–3) may be provided to house the cable sections 148, 158 as they approach the clamping portion of the joint. Bell-shaped corona shields 136 may be provided to surround a region about each ferrule 124. The corona shields 136 are preferably mechanically and electrically attached to the ferrules 124 by attachment plates or bulkheads 134 extending radially from the ferrules between the end of insulators 142 and the conductor clamp 100. The corona shields 136 may be attached to the bulkheads 134 using suitable fasteners 138 of conventional design. Each of the bulkheads 134 has a threaded center hole to receive one of the ferrules. The bulkhead 134 may be secured to the ferrule 124 using a suitable fastener 140, such as a threaded nut. Preferably, a small gap is provided between the bulkhead 134 and the top surface of insulator 142.

The second cavity 128 of ferrule 124 is provided to receive a conductor insert 130. The conductor insert is used to secure the ferrules in a desired longitudinal position with respect to the conductor clamp 100. The conductor insert 130 comprises a substantially cylindrical stud portion 172 and a disk shaped flange portion 132 attached to an end of the stud portion 172. As will be discussed further in detail, the flange portion 132 of the conductor inserts 130 is retained within an enlarged cavity 216 (FIG. 3) in the conductor clamp 100. The flange portions 132 of conductor inserts 130 interfere with the Walls 242 of the cavity 216 in clamping elements 112, 114, thereby longitudinally constraining the conductor inserts 130, and the ferrules 124.

Since large forces may be applied to the conductor insert, a transition section 150 of intermediate diameter and having radiused corners is provided between the flange portion 132 and the stud portion 172 of the conductor inserts. The transition section 150 prevents concentrations of mechanical stress which might otherwise occur at a sharp junction between the flange and stud portions and which may tend to cause a failure at the junction. The conductor insert 130 may be provided with chamfered edges 176 to avoid damage during handling.

The second cavity 128 and the conductor insert 130 preferably include cooperative means to retain the conductor insert 130 in an adjustable longitudinal position in the cavity 128. Preferably, the second cavity 128 is threaded, and the conductor insert 130 is provided with mating threads 152, so that the longitudinal position of the insert 130 in cavity 128 may be adjusted by rotating the insert. Such mating threads 152 are preferred because they permit variable adjustment and are capable of withstanding large tension loads which may be applied to the ferrules 124 by the cables 148, 158. However, other means to adjustably retain the conductor insert 130 in a desired position in cavity 128 could also be used if they provide sufficient strength to withstand large tension loads.

The conductor clamp 100 comprises two substantially identical clamping elements 112, 114 (FIGS. 3–6). The clamping elements 112, 114 are preferably formed as shell pieces having semi-cylindrical structural walls 202. The shell pieces 112, 114 are subsequently assembled together so that their concave inner surfaces face each other. When so assembled, the shell pieces 112, 114 form a substantially cylindrical central channel 200 aligned along a longitudinal axis 226. Although the conductor clamp 100 is described herein as having generally cylindrical structural elements forming a generally cylindrical, central channel, the clamp 100 could employ other structural arrangements as needed. For example, it may be desirable to accommodate ferrules having non-cylindrical geometries (e.g. square, triangular, or other cross-sections), in which case the interior surfaces of the structural walls would be modified to correspond to such geometries.

Means are provided to fasten the two shell pieces 112, 114 into secure clamping engagement with the two ferrules 124. Suitable apertures 210, 212 are provided in each shell piece to accommodate appropriate fasteners 244. The fasteners extend through the apertures 210, 212 toward the opposing shell piece and are received in mating apertures 204, 214 which may be formed as a closed bore 242 in the wall 202 of the shell pieces. The fasteners 244 may, for example, be a conventional threaded bolt, or other suitable fastening means. The fasteners 244 are preferably removable, thereby allowing the shell pieces 112, 114 to be disassembled. This permits the joint 100 to be easily disconnected when required.

Figure 4:
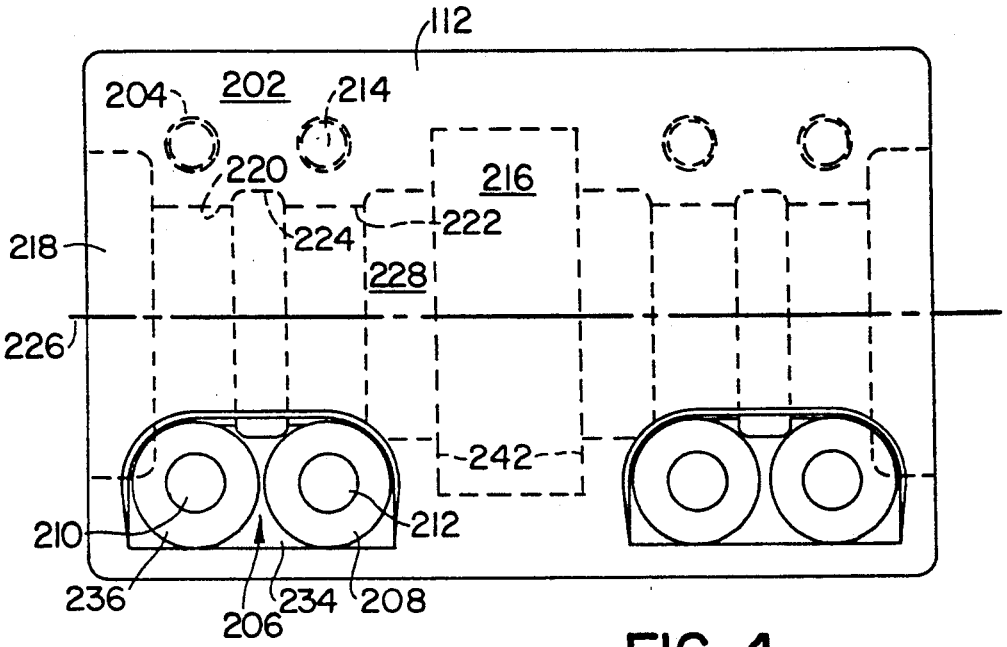
FIG. 4 is a cross-section view of the conductor clamp taken along the view lines 4—4 of FIG. 6.
Figure 5:
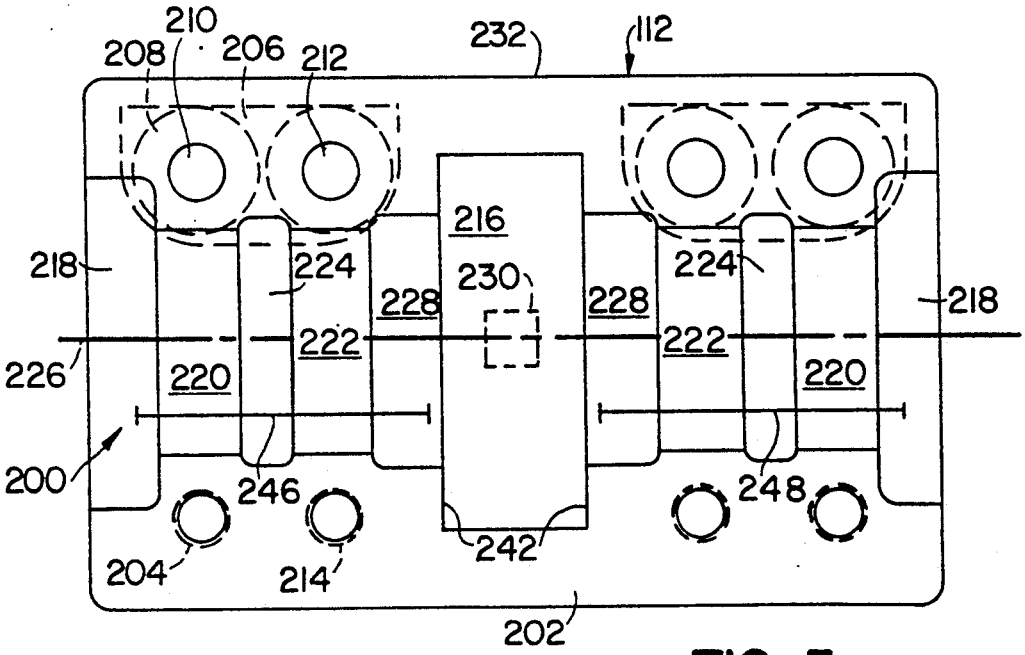
FIG. 5 is a cross-section view of the conductor clamp taken along the view lines 5—5 of FIG. 6.
Figure 6:
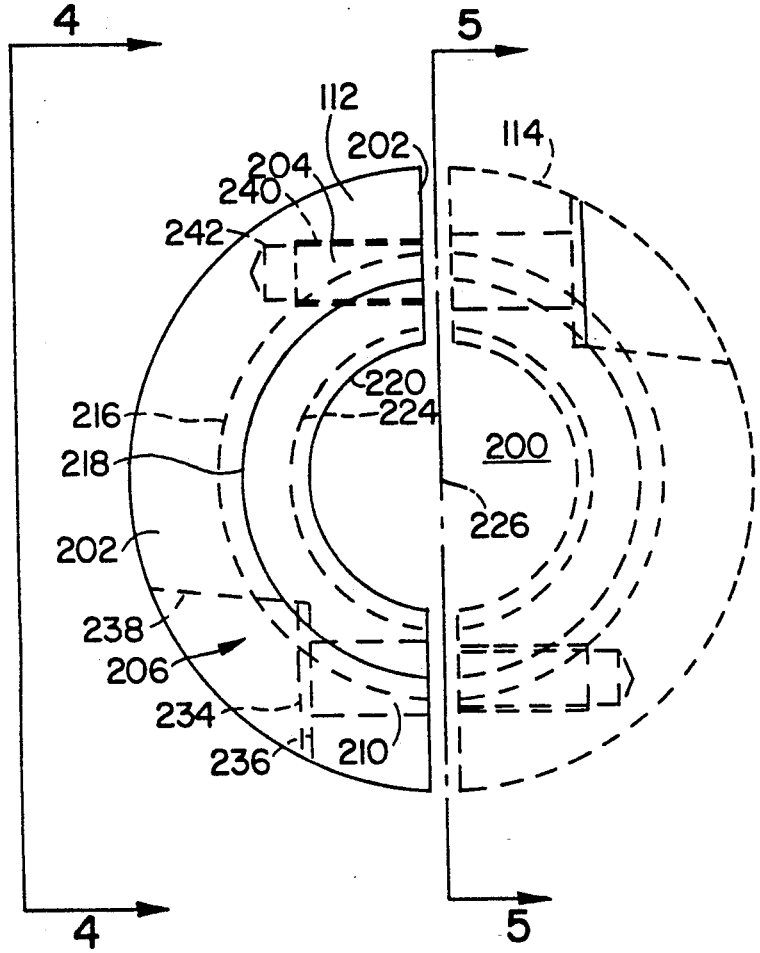
FIG. 6 is an end cross-section view of the conductor clamp taken along the view lines 6—6 of FIG. 3.

Receiving apertures 204, 214 preferably include means, such as threads 240, compatible with the fastener 244 for adjustably retaining the fastener 244 so that the shell pieces 112, 114 may be urged together. Preferably, relieved regions 206 are provided in the outside walls 232 of the shell pieces to provide clearance for the head of the fastener 244 and to provide planar surfaces 208, 236 perpendicular to the long axis of the fastener for proper seating of the fastener head. As best seen in FIGS. 4–6, the relieved region forms a side wall 238 and a land area 234.

The central channel comprises first and second regions 246, 248 of restricted diameter (hereafter, narrower regions) which extend longitudinally inward from the outer ends of the shell pieces 112, 114. The narrower regions 246, 248 communicate with an intermediate region or cavity 216 having a diameter substantially larger than that of the narrower regions 246, 248. The enlarged intermediate region 216 extends radially outward into the wall portion 202 of the shell pieces 112, 114. Accordingly, the enlarged intermediate region 216 has side walls 242 (FIGS. 3–5) formed at the junction between the region 216 and the narrower regions 246, 248.

The narrower regions 246, 248 of the central channel 200 comprise several surface features to enhance operation of the conductor clamp 100. Contact surfaces 220, 222 are formed by radially-inwardly extending constrictions or ridges in the inner wall of the central channel 200. The contact surfaces 220, 222 are preferably positioned adjacent the fastener apertures 204, 214, 210, 212 (i.e. their centers are aligned on a plane perpendicular to the longitudinal axis of the central channel 200) to maximize the force with which the contact surfaces 220, 222 may be urged into engagement with the ferrules 124. This ensures that the contact area between contact surfaces 220, 222 of the conductor clamp 100 and the outer surface of the ferrules 124 will be as large as possible, thereby ensuring a high-conductivity electrical connection between the conductor clamp 100 and the ferrules 124. A region of slightly larger diameter 224 is provided between contact surfaces 220 and 222.

An enlarged-diameter region 218 is provided on each end of the central channel 200 to accommodate the fastener 140 which secures bulkhead 134 to the ferrule 124 (see FIG. 3). Additional enlarged-diameter regions 228 are provided in the inner ends of narrower regions 246, 248 to accommodate the transition section 150 between the flange and stud portions of the conductor inserts 130.

The joint 102 is formed by the steps of: installing the ferrules 124 on respective cable center conductors 108, 110; installing the conductor inserts 130 in the ferrules 124; bringing the ferrules 124 into approximate axial and longitudinal alignment; adjusting the conductor inserts 130 into approximate abutment; assembling the shell pieces 112, 114 of the conductor clamp 100 about the ferrules 124 and conductor inserts 130 such that the disk-shaped flange portions 132 are located within the enlarged intermediate region 216 of the central channel; and fastening the shell pieces 112, 114 together into tight mechanical and electrical engagement with the ferrules 124.

As previously noted, the conductor clamp 100 longitudinally constrains the cable center conductors 108, 110 and associated components by retaining the disk-shaped flange portions 132 of the conductor inserts 130 within the enlarged intermediate region 216 of the central channel. Because the disk-shaped flange portions 132 are larger in diameter than the narrower regions 246, 248 of the central channel 200, their retention advantageously does not depend on extremely tight frictional engagement between the conductor clamp 100 and the ferrules 124. Similarly, due to the opposed semi-cylindrical design of the conductor clamp shell pieces 112, 114, the clamp forces the conductor inserts into axial alignment as the fasteners 244 are tightened, thereby advantageously eliminating the need for precise axial alignment of the conductors 108, 110 or ferrules 124 prior to installation of the clamp. Further, because the longitudinal position of the conductor inserts 130 is easily adjusted, the need for precise longitudinal alignment of conductors 108, 110 or ferrules 124 is also advantageously eliminated.

The above-described embodiment of the invention is merely one example of a way in which the invention may be carried out. Other ways may also be possible, and are within the scope of the following claims defining the invention.

What is claimed is:

1. A device for joining first and second sections of an electric power transmission cable, each section having a center conductor and a solid dielectric, comprising:

a first conductor extension mechanically and electrically attached to the center conductor of the first cable section:

a second conductor extension mechanically and electrically attached to the center conductor of the second cable section;

said first and second conductor extensions extending longitudinally from said cable section center conductors; and clamp means for mechanically and electrically attaching said first conductor extension to said second conductor extension;

said first conductor extensions, said second conductor extension, and said clamp means cooperating to retain said first and second cable sections in an adjustable longitudinal relationship;

each of said first and second conductor extensions further comprising:

a substantially cylindrical wall;

said wall forming a cavity extending longitudinally inward from an end of said conductor extension for receiving a conductor insert, said conductor insert having an exposed portion extending longitudinally outward from said end of said conductor extension.

2. The cable joining device of claim 1 wherein each of said conductor inserts comprises an extended cylindrical stud portion for installation in said conductor extension cavity and a disk-shaped flange portion attached to an exposed end of said stud portion, said flange portion having a diameter substantially greater than that of said stud portion.

3. The cable joining device of claim 2 wherein said cavity and said conductor insert comprise cooperative means for adjustably retaining said stud portion in a desired longitudinal position with respect to said conductor extension.

4. The cable joining device of claim 3 wherein said cooperative means comprises threads on interior wall surfaces of said cavity and mating threads on exterior surfaces of said stud portion of said conductor inserts whereby the longitudinal position of said conductor insert with respect to said conductor extension is adjustable by axial rotation of said conductor insert.

5. The cable joining device of claim 1 wherein: said first conductor extension, said second conductor extension, and said clamp means cooperate to form a high-current electrically conductive path substantially excluding said conductor inserts.

6. A device for joining first and second sections of an electric power transmission cable, each section having a center conductor and a solid dielectric, comprising:

first and second conductor inserts;

a first conductor extension mechanically and electrically attached to the center conductor of the first cable section;

a second conductor extension mechanically and electrically attached to the center conductor of the second cable section;

said first and second conductor extensions each comprising longitudinally-extending wall sections, said wall sections comprising a cavity for receiving a conductor insert;

said first and second conductor inserts being respectively removably installed in said cavities of said conductor extensions, said conductor inserts each comprising a stud portion installed in said conductor extension cavity and a disk-shaped flange portion attached to said stud portion and disposed outside of said cavity; and clamp means for mechanically and electrically attaching said first conductor extension to said second conductor extension.

7. The cable joining device of claim 6 wherein said clamp means comprises:

first and second clamping elements, said first and second clamping elements each having structural walls, said structural walls of said first and second clamping elements arranged in opposition to one another to form a channel for receiving said first and second conductor extensions and said first and second conductor inserts, said clamp means having means for urging the first and second clamping elements toward one another into tight frictional engagement with said first and second conductor extensions;

said channel of said clamp means having first and second regions of intermediate diameter extending inward from the ends of said channel, a region of enlarged diameter intermediate said first and second intermediate diameter regions for receiving said flange portions of said conductor inserts, and first and second regions of reduced diameter adjacent said intermediate diameter regions for mechanically and electrically contacting said conductor extensions.

8. The cable joining device of claim 7 wherein:

each of said first and second clamp elements is formed as a shell piece having walls forming a substantially cylindrical concave inner surface; and said concave inner surfaces of said first and second clamp elements are arranged in opposition to one another to form a substantially cylindrical central channel for receiving said first and second conductor extensions and said first and second conductor inserts.

9. The cable joining device of claim 6 wherein said cavity and said conductor insert comprises cooperative means for adjustably retaining said stud portion in a desired longitudinal position with respect to said conductor extension.

10. The cable joining device of claim 9 wherein said cooperative means comprises threads on interior wall surfaces of said cavity and mating threads on exterior surfaces of said stud portion of said conductor inserts whereby the longitudinal position of said conductor insert with respect to said conductor extension is adjustable by axial rotation of said conductor insert.

11. The cable joining device of claim 6 wherein said clamp means comprises:

first and second clamping elements;

said first and second clamping elements each having structurals walls;

said structural walls of said first and second clamping elements being arranged in opposition to one another to form a channel for receiving said first and second conductor extensions and said first and second conductor inserts;

said clamp means having means for urging the first and second clamping elements toward one another into tight frictional engagement with said first and second conductor extensions;

said channel of said clamp means having first and second regions of intermediate diameter extending radially inward from the ends of said channel, a region of enlarged diameter disposed longitudinally between said first and second intermediate diameter regions for receiving said flange portions of said conductor inserts, and contact enhancement means provided on said walls in said intermediate diameter regions for improving the electrical conductivity between said clamping elements and said conductor extensions.

12. The cable joining device of claim 11 wherein said contact enhancement means comprises at least one ridge extending inwardly from said walls in at least one of said intermediate diameter regions, said ridge having a diameter smaller than said intermediate diameter region.

13. The cable joining device of claim 6 wherein: said first conductor extension, said second conductor extension, and said clamp means cooperate to form a high-current electrically conductive path substantially excluding said first and second conductor inserts.

* * * * *